US008927448B2

(12) United States Patent
Kou et al.

(10) Patent No.: US 8,927,448 B2
(45) Date of Patent: Jan. 6, 2015

(54) HYDROPROCESSING CATALYSTS AND METHODS FOR MAKING THEREOF

(75) Inventors: Bo Kou, Albany, CA (US); Julie Chabot, Novato, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 783 days.

(21) Appl. No.: 13/233,491

(22) Filed: Sep. 15, 2011

(65) Prior Publication Data

US 2012/0004091 A1 Jan. 5, 2012

Related U.S. Application Data

(63) Continuation-in-part of application No. 13/103,790, filed on May 9, 2011, now Pat. No. 8,435,400, and a continuation-in-part of application No. 12/506,937, filed on Jul. 21, 2009, now Pat. No. 8,236,169.

(60) Provisional application No. 61/428,599, filed on Dec. 30, 2010.

(51) Int. Cl.

| | |
|---|---|
| ***B01J 38/48*** | (2006.01) |
| ***C10G 47/02*** | (2006.01) |
| ***C10G 47/26*** | (2006.01) |
| ***C10G 65/00*** | (2006.01) |
| ***C10G 65/10*** | (2006.01) |
| ***C10G 65/18*** | (2006.01) |

(52) U.S. Cl.

CPC ..... *C10G 47/02* (2013.01); *C10G 47/26* (2013.01); *C01G 47/32* (2013.01); *C10G 65/00* (2013.01); *C10G 65/10* (2013.01); *C10G 65/18* (2013.01); *C10G 2300/701* (2013.01); *C10G 2300/802* (2013.01); *C10G 2300/205* (2013.01); *C10G 2300/206* (2013.01)

USPC ..... 502/27; 502/20; 502/22; 502/29

(58) Field of Classification Search

CPC ..... B01J 21/20; B01J 38/48; B01J 38/50; B01J 38/52; B01J 38/54; B01J 38/60

USPC ..... 502/20, 22, 27, 29

See application file for complete search history.

(56) References Cited

U.S. PATENT DOCUMENTS

| | | |
|---|---|---|
| 3,817,856 A | 6/1974 | Aaron et al. |
| 4,087,354 A | 5/1978 | Hessler |

(Continued)

OTHER PUBLICATIONS

U.S. Appl. No. 13/233,455, filed Sep. 15, 2011, Yang, et al.

(Continued)

*Primary Examiner* — Brian McCaig

(57) ABSTRACT

A method to prepare an improved catalyst feed to a system to upgrade heavy oil. The method comprises: providing a spent catalyst that has been used in a hydroprocessing operation has with a solid content ranging from 5 to 50 wt. % in soluble hydrocarbons and having less than 80% but more than 10% of original catalytic activity; removing at least 50% of the soluble hydrocarbons removed in a deoiling step; treating the deoiled spent catalyst with a treating solution containing at least one of plain water, a mineral acid, an oxidizing agent, and combinations thereof to reduce the concentration of at least one metal contaminant in the deoiled spent catalyst by at least 40%. After treatment, the treated deoiled spent catalyst is slurried in a hydrocarbon medium, and fed to the heavy oil upgrade system as part of the catalyst feed system with a fresh slurry catalyst.

21 Claims, 2 Drawing Sheets

(56) References Cited

U.S. PATENT DOCUMENTS 4,440,868 A 4/1984 Hettinger, Jr. et al.
4,485,004 A 11/1984 Fisher et al.
4,592,827 A 6/1986 Galiasso et al.
4,684,456 A 8/1987 Van Driesen et al.
4,710,486 A 12/1987 Lopez et al.
4,824,821 A 4/1989 Lopez et al.
4,853,106 A 8/1989 Grove et al.
4,929,336 A * 5/1990 Lowery et al. ..... 208/120.2
4,943,547 A 7/1990 Seamans et al.
4,961,840 A 10/1990 Goyal
4,969,988 A 11/1990 Jain et al.
4,970,190 A 11/1990 Lopez et al.
5,039,392 A 8/1991 Bearden, Jr. et al.
5,041,404 A 8/1991 Seamans et al.
5,162,282 A 11/1992 Lopez et al.
5,164,075 A 11/1992 Lopez
5,178,749 A 1/1993 Lopez et al.
5,286,691 A 2/1994 Harandi et al.
5,298,152 A 3/1994 Kramer
5,371,308 A 12/1994 Gosselink et al.
5,374,348 A 12/1994 Sears et al.
5,484,755 A 1/1996 Lopez
5,527,473 A 6/1996 Ackerman
5,871,638 A 2/1999 Pradhan et al.
5,888,919 A * 3/1999 Bartholic ..... 502/22
5,914,010 A 6/1999 Hood et al.
5,925,238 A 7/1999 Duddy et al.
5,935,418 A 8/1999 Chakrabarty et al.
5,954,945 A 9/1999 Cayton et al.
5,977,192 A 11/1999 Howsmon et al.
5,998,328 A 12/1999 Dawes et al.
6,030,915 A 2/2000 de Boer
6,071,402 A 6/2000 Danot et al.
6,139,723 A 10/2000 Pelrine et al.
6,156,693 A 12/2000 Song et al.
6,156,695 A 12/2000 Soled et al.
6,162,350 A 12/2000 Soled et al.
6,190,542 B1 2/2001 Comolli et al.
6,241,855 B1 6/2001 Gibson et al.
6,241,874 B1 6/2001 Wallace et al.
6,270,654 B1 8/2001 Colyar et al.
6,274,530 B1 8/2001 Cayton et al.
6,277,895 B1 8/2001 Zhou et al.
6,278,034 B1 8/2001 Espinoza et al.
6,291,391 B1 9/2001 MacArthur
6,299,760 B1 10/2001 Soled et al.
6,451,729 B1 9/2002 Song et al.
6,482,315 B1 11/2002 Roberie et al.
6,534,437 B2 3/2003 Eijsbouts et al.
6,554,994 B1 4/2003 Reynolds et al.
6,620,313 B1 9/2003 Demmin et al.
6,630,066 B2 10/2003 Cash et al.
6,635,599 B1 10/2003 Eijsbouts et al.
6,652,738 B2 11/2003 Eijsbouts et al.
6,660,157 B2 12/2003 Que et al.
6,712,955 B1 3/2004 Hou et al.
6,726,832 B1 4/2004 Baldassari et al.
6,758,963 B1 7/2004 Hantzer et al.
6,846,403 B2 1/2005 Cheng et al.
6,852,214 B1 2/2005 Chester et al.
6,923,903 B2 8/2005 Chester et al.
7,150,823 B2 12/2006 Mayer et al.
7,179,366 B2 2/2007 Harle et al.
7,214,308 B2 5/2007 Colyar
7,223,713 B2 5/2007 Alonso et al.
7,232,515 B1 6/2007 Demmin et al.
7,297,250 B2 11/2007 Bronicki
7,358,413 B2 4/2008 Stell et al.
7,413,669 B2 8/2008 Gonzalez et al.
7,416,653 B2 8/2008 Wellington et al.
7,803,267 B2 9/2010 Chester et al.
7,820,579 B2 10/2010 Ginestra et al.
7,906,447 B2 3/2011 McCarthy et al.
2002/0010088 A1 1/2002 Eijsbouts et al.
2002/0012517 A1 1/2002 Ichioka et al.
2002/0153283 A1 10/2002 Chester et al.
2002/0166797 A1 11/2002 Banerjee
2002/0179498 A1 12/2002 Chester et al.
2003/0034275 A1 2/2003 Roberie et al.
2003/0075481 A1 4/2003 Chester et al.
2003/0089636 A1 5/2003 Marchionna et al.
2003/0089639 A1 5/2003 Chester et al.
2003/0102254 A1 6/2003 Eijsbouts et al.
2003/0150778 A1 8/2003 Haluska et al.
2004/0134837 A1 7/2004 Dassori
2004/0163999 A1 8/2004 Plantenga et al.
2004/0226860 A1 11/2004 Bourges et al.
2005/0040080 A1 2/2005 Riley et al.
2005/0145538 A1 7/2005 Wellington et al.
2005/0145543 A1 7/2005 Bhan et al.
2005/0150818 A1 7/2005 Bhan et al.
2005/0155908 A1 7/2005 Bhan et al.
2005/0159295 A1 7/2005 Ginestra et al.
2005/0167320 A1 8/2005 Bhan et al.
2005/0167321 A1 8/2005 Wellington et al.
2005/0167322 A1 8/2005 Wellington et al.
2005/0167323 A1 8/2005 Wellington et al.
2005/0167324 A1 8/2005 Bhan et al.
2005/0167326 A1 8/2005 Bhan et al.
2005/0167327 A1 8/2005 Bhan et al.
2005/0167328 A1 8/2005 Bhan et al.
2005/0167329 A1 8/2005 Bhan et al.
2005/0167330 A1 8/2005 Bhan et al.
2005/0167331 A1 8/2005 Bhan et al.
2005/0167332 A1 8/2005 Bhan et al.
2005/0173298 A1 8/2005 Wellington et al.
2005/0173301 A1 8/2005 Bhan et al.
2005/0173302 A1 8/2005 Bhan et al.
2005/0173303 A1 8/2005 Bhan et al.
2005/0189260 A1 9/2005 Chester et al.
2005/0241992 A1 11/2005 Lott et al.
2005/0241993 A1 11/2005 Lott et al.
2006/0011511 A1 1/2006 Hokari et al.
2006/0054535 A1 3/2006 Chen et al.
2006/0060501 A1 3/2006 Gauthier et al.
2006/0060502 A1 3/2006 Soled et al.
2006/0060503 A1 3/2006 Soled et al.
2006/0157385 A1 7/2006 Montanari et al.
2006/0163115 A1 7/2006 Montanari et al.
2006/0175229 A1 8/2006 Montanari et al.
2006/0186021 A1 8/2006 Marchionna et al.
2006/0201854 A1 9/2006 Lott
2006/0207917 A1 9/2006 Domokos et al.
2006/0231465 A1 10/2006 Bhan
2006/0272982 A1 12/2006 Montanari et al.
2006/0289340 A1 12/2006 Brownscombe et al.
2007/0000808 A1 1/2007 Bhan et al.
2007/0000810 A1 1/2007 Bhan et al.
2007/0007168 A1 1/2007 Zhao et al.
2007/0012595 A1 1/2007 Brownscombe et al.
2007/0045156 A1 3/2007 Khadzhiev et al.
2007/0056881 A1 3/2007 Berkowitz et al.
2007/0084754 A1 4/2007 Soled et al.
2007/0090023 A1 4/2007 Soled et al.
2007/0090024 A1 4/2007 Soled et al.
2007/0116615 A1 5/2007 Schulz Van Endert et al.
2007/0144941 A1 6/2007 Hokari et al.
2007/0158236 A1 7/2007 Zhou et al.
2007/0158238 A1 7/2007 Wu et al.
2007/0161505 A1 7/2007 Pereira-Almao et al.
2007/0238607 A1 10/2007 Alonso et al.
2007/0284285 A1 12/2007 Stepanik et al.
2007/0295641 A1 12/2007 Brownscombe et al.
2007/0295645 A1 12/2007 Brownscombe et al.
2007/0295646 A1 12/2007 Bhan et al.
2007/0295647 A1 12/2007 Brownscombe et al.
2008/0083650 A1 4/2008 Bhan et al.
2008/0083652 A1 4/2008 Morel et al.
2008/0083655 A1 4/2008 Bhan et al.
2008/0085225 A1 4/2008 Bhan et al.
2008/0087575 A1 4/2008 Bhan et al.
2008/0087578 A1 4/2008 Bhan et al.
2008/0099371 A1 5/2008 McCoy et al.
2008/0099373 A1 5/2008 Hokari et al.

(56) References Cited

U.S. PATENT DOCUMENTS

| | | | |
|---|---|---|---|
| 2008/0099377 | A1 | 5/2008 | He et al. |
| 2009/0005520 | A1 | 1/2009 | Kiss et al. |
| 2009/0032436 | A1 | 2/2009 | Takahashi et al. |
| 2009/0101574 | A1 | 4/2009 | Zubot et al. |
| 2009/0107881 | A1 | 4/2009 | Lott et al. |
| 2009/0137731 | A1 | 5/2009 | Sekiyama et al. |
| 2009/0139715 | A1 | 6/2009 | Choi |
| 2009/0139902 | A1 | 6/2009 | Kressmann et al. |
| 2009/0152165 | A1 | 6/2009 | Etter |
| 2009/0258779 | A1 | 10/2009 | McCarthy et al. |
| 2009/0261019 | A1 | 10/2009 | McCarthy et al. |
| 2010/0133148 | A1 | 6/2010 | Timmler et al. |
| 2010/0170827 | A1 | 7/2010 | Etter |
| 2010/0230324 | A1 | 9/2010 | Al-Alloush et al. |

OTHER PUBLICATIONS

U.S. Appl. No. 13/233,477, filed Sep. 15, 2011, Yang, et al.

Pecoraro et al., Hydrodesulfurization Catalysis by Transition Metal Sulfides by Journal of Catalysis (1981) 67, 430-445.

Barnes et al., A review of zinc dialkyldithiophosphates (ZDDPS): characterization and role in the lubricating oil (2001) Tribology International 34 389-395.

N. Panariti, Petroleum residue upgrading with dispersed catalysts Part I. Catalysts activity and selectivity (2000), Applied Catalysis A: General 204 203-213.

Chadha et al., Iron sulfide Catalysts for Coal Liquefaction Prepared Using a Micellar Technique, 1996, Ind. Eng. Chem. Res., 35, 2916-2919.

Brown et al., Nickel, Cadium and Lead Sulfides as Catalysts in the Vapor Phase Reduction of Nitrobenzene, Jul. 29, 1938, Laboratory of Physical Chemistry, Indiana University.

Le et al., Solution Synthesis of the unsupported Ni-W sulfide hytrotreating catalysts, (2008) Catalysis Today 130 24-31.

Thompson et al., Thermal decomposition of sulfur comppunds. I. 2-Methy1-2-propanethiol, Nov. 19, 1951, Bureau of Mines, Petroleum and Oil-Shale Experiment Station.

Ancheyta et al., Hydroprocessing of heavy petroleum feeds: tutorial (2005) Catalysis Today 109 3-15.

Rana et al., A review of recent advances on process technologies for upgrading of heavy oils and residue (2007) Fuel 86 1216-1231.

* cited by examiner

HYDROPROCESSING CATALYSTS AND METHODS FOR MAKING THEREOF

CROSS-REFERENCE TO RELATED APPLICATIONS

This application claims benefit under 35 USC 119 of U.S. Provisional Patent Application No. 61/428,599 with a filing date of Dec. 30, 2010. This application is also continuation-in-part (CIP) of U.S. patent application Ser. No. 12/506,937 with a filing date of Jul. 21, 2009; a CIP of U.S. patent application Ser. No. 13/103,790 with a filing date of May 9, 2011. This application claims priority to and benefits from the foregoing, the disclosures of which are incorporated herein by reference.

TECHNICAL FIELD

The invention relates generally to catalysts for use in the conversion of heavy oils and residua and methods for making thereof.

BACKGROUND

The petroleum industry is increasingly turning to heavy crudes, resids, coals and tar sands as sources for feedstocks. Feedstocks derived from these heavy materials contain more sulfur and nitrogen than feedstocks derived from more conventional crude oils, requiring a considerable amount of upgrading in order to obtain usable products therefrom. These heavier and high sulfur crudes and resides also present problems as they invariably also contain much higher metals contaminant metals such as nickel, vanadium, and iron, which represent operating problems in terms of metal deposit/build-up in the equipment.

The upgrading of heavy oil feedstock is accomplished by hydrotreating processes, i.e., treating with hydrogen of various hydrocarbon fractions, or whole heavy feeds, or feedstocks, in the presence of hydrotreating catalysts to effect conversion of at least a portion of the feeds, or feedstocks to lower molecular weight hydrocarbons, or to effect the removal of unwanted components, or compounds, or their conversion to innocuous or less undesirable compounds.

Catalysts commonly used for these hydrotreating reactions include materials such as cobalt molybdate on alumina, nickel on alumina, cobalt molybdate promoted with nickel, nickel tungstate, at least a group VIB metal compound with at least a promoter metal compound, etc. High catalyst dosage will improve the conversion rate and reduce solid accumulation in the process equipment. However, there is an economic limitation as how much catalyst can be used, as a high dosage will drive up capital and operating costs.

There is still a need for improved catalysts with balanced material costs, while still offering excellent morphology, structure and catalytic activity. There is also a need for improved processes to prepare catalysts for use in the conversion of heavy oils and residua. There is a further a need for improved heavy oil upgrade processes with reduced build-up of heavy metal contaminants.

SUMMARY OF THE INVENTION

In one aspect, the invention relates to a catalyst feed system for use in the upgrade of heavy oil feedstock. The catalyst feed system comprises: a) a deoiled spent catalyst comprising a plurality of dispersed particles slurried in a hydrocarbon medium as a slurry, the deoiled catalyst retaining less than 80% but more than 10% of its original catalytic activity; and b) a fresh slurry catalyst comprising a plurality of dispersed particles in a hydrocarbon medium as a slurry. The deoiled spent catalyst is present in an amount of at least 10% the catalyst feed system to trap metal contaminants in the system and reduce metal deposits.

In another aspect, the invention relates to a method to trap metal contaminants from a heavy oil feedstock in a system to upgrade the heavy oil feedstock. The method comprises providing to the heavy oil upgrade system a catalyst feed, which contains: a) a fresh slurry catalyst comprising a plurality of dispersed particles in a hydrocarbon medium as a slurry; and b) a deoiled spent catalyst comprising a plurality of dispersed particles slurried a hydrocarbon medium as a slurry. The deoiled spent catalyst has less than 80% but more than 10% of original catalytic activity, and the deoiled spent catalyst is present in the catalyst feed in a sufficient amount to trap the metal contaminants for the upgrade system to have a reduction of at least 5% in metal contaminant deposit.

In yet another aspect, the invention relates to a method to prepare a catalyst feed for a heavy oil upgrade system. The method comprises the steps of: providing spent catalyst with a solid content ranging from 5 to 50 wt. % in soluble hydrocarbons and having less than 80% but more than 10% of original catalytic activity; removing at least 50% of the soluble hydrocarbons removed in a deoiling step, generating a deoiled spent catalyst with at least a metal contaminant; treating the deoiled spent catalyst with a treating solution to reduce the concentration of metal contaminants; slurring the treated deoiled spent catalyst in a hydrocarbon medium, generating a treated deoiled spent catalyst slurry; and feeding the treated deoiled spent catalyst slurry to a heavy oil upgrade system with a fresh slurry catalyst.

DETAILED DESCRIPTION

Figure 1:
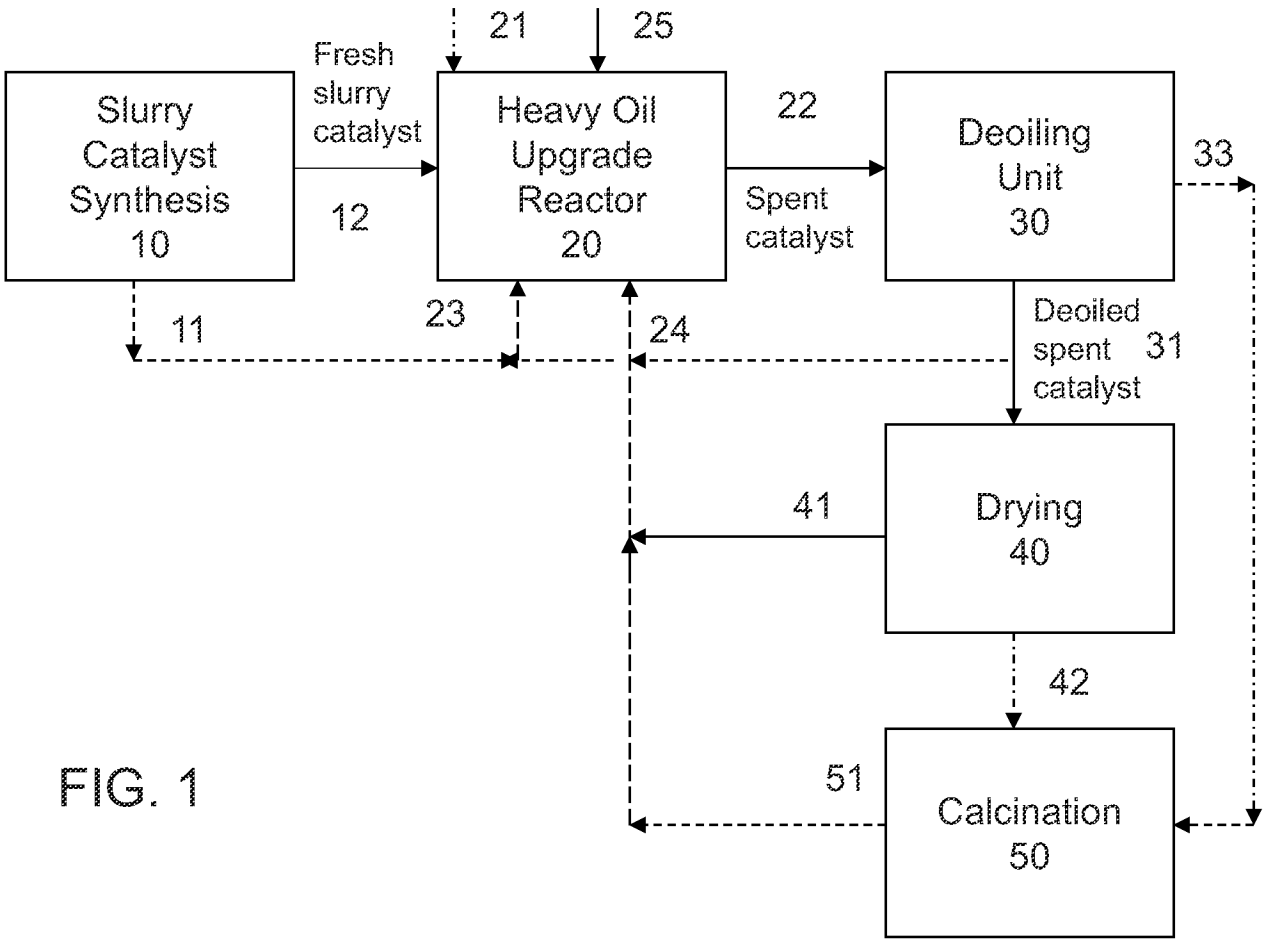
FIG. 1 schematically illustrate embodiments of a hydroconversion process to upgrade heavy oil with a slurry catalyst feed system comprising a deoiled spent catalyst.

The following terms will be used throughout the specification and will have the following meanings unless otherwise indicated.

"Bulk catalyst" may be used interchangeably with "slurry catalyst" or "unsupported catalyst," meaning that the catalyst composition is NOT of the conventional catalyst form with a preformed, shaped catalyst support which is then loaded with metals via impregnation or deposition catalyst. In one embodiment, the bulk catalyst is formed through precipitation. In another embodiment, the bulk catalyst has a binder incorporated into the catalyst composition. In yet another embodiment, the bulk catalyst is formed from metal compounds and without any binder. The bulk catalyst is a dispersing-type catalyst ("slurry catalyst") type with dispersed particles in a liquid mixture (e.g., hydrocarbon oil).

"Fresh catalyst" refers to a catalyst that has not been used for hydroprocessing.

"Spent catalyst" refers to a catalyst that has been used in a hydroprocessing operation and whose activity has thereby been diminished. For example, if a reaction rate constant of a fresh catalyst at a specific temperature is assumed to be 100%, the reaction rate constant for a spent catalyst temperature is 80% or less in one embodiment (retaining less than 80% of the original catalytic activity), and 50% or less in another embodiment.

"Soluble hydrocarbons" refer to hydrocarbons that are soluble in physical solvents. An example is heavy oil/unconverted resid, and not coke which is not soluble in physical solvents.

"Deoiled spent catalyst" refers to a spent catalyst after the removal of at least 50% of soluble hydrocarbons from the spent catalyst. The deoiled spent catalyst contains less than 25 wt. % soluble hydrocarbons in one embodiment; less than 10 wt. % soluble hydrocarbons in another embodiment; less than 5 wt. % soluble hydrocarbons in a third embodiment; and less than 2 wt. % soluble hydrocarbons in a fourth embodiment.

"Heavy oil" feed or feedstock refers to heavy and ultra-heavy crudes, including but not limited to resids, coals, bitumen, tar sands, oils obtained from the thermo-decomposition of waste products, polymers, biomasses, oils deriving from coke and oil shales, etc. Heavy oil feedstock may be liquid, semi-solid, and/or solid. Examples of heavy oil feedstock that might be upgraded as described herein include but are not limited to Canada Tar sands, vacuum resid from Brazilian Santos and Campos basins, Egyptian Gulf of Suez, Chad, Venezuelan Zulia, Malaysia, and Indonesia Sumatra. Other examples of heavy oil feedstock include residuum left over from refinery processes, including "bottom of the barrel" and "residuum" (or "resid"), atmospheric tower bottoms, which have a boiling point of at least 343° C. (650° F.), or vacuum tower bottoms, which have a boiling point of at least 524° C. (975° F.), or "resid pitch" and "vacuum residue" which have a boiling point of 524° C. (975° F.) or greater.

Properties of heavy oil feedstock may include, but are not limited to: TAN of at least 0.1, at least 0.3, or at least 1; viscosity of at least 10 cSt; API gravity at most 15 in one embodiment, and at most 10 in another embodiment. A gram of heavy oil feedstock typically contains at least 0.0001 grams of Ni/V/Fe; at least 0.005 grams of heteroatoms; at least 0.01 grams of residue; at least 0.04 grams C5 asphaltenes; at least 0.002 grams of micro residue (MCR); per gram of crude; at least 0.00001 grams of alkali metal salts of one or more organic acids; and at least 0.005 grams of sulfur. In one embodiment, the heavy oil feedstock has a sulfur content of at least 5 wt. % and an API gravity ranging from −5 to +5. A heavy oil feed such as Athabasca bitumen (Canada) typically has at least 50% by volume vacuum reside. A Boscan (Venezuela) heavy oil feed may contain at least 64% by volume vacuum residue. A Borealis Canadian bitumen may contain about 5% sulfur, 19% of asphaltenes and insoluble $THF_1$ (tetrahydrofuran) of less than 1 kg/ton.

"Treatment," "treated," "upgrade", "upgrading" and "upgraded", when used in conjunction with a heavy oil feedstock, describes a heavy oil feedstock that is being or has been subjected to hydroprocessing, or a resulting material or crude product, having a reduction in the molecular weight of the heavy oil feedstock, a reduction in the boiling point range of the heavy oil feedstock, a reduction in the concentration of asphaltenes, a reduction in the concentration of hydrocarbon free radicals, and/or a reduction in the quantity of impurities, such as sulfur, nitrogen, oxygen, halides, and metals.

The upgrade or treatment of heavy oil feeds is generally referred herein as "hydroprocessing" (hydrocracking, or hydroconversion). Hydroprocessing is meant as any process that is carried out in the presence of hydrogen, including, but not limited to, hydroconversion, hydrocracking, hydrogenation, hydrotreating, hydrodesulfurization, hydrodenitrogenation, hydrodemetallation, hydrodearomatization, hydroisomerization, hydrodewaxing and hydrocracking including selective hydrocracking. The products of hydroprocessing may show improved viscosities, viscosity indices, saturates content, low temperature properties, volatilities and depolarization, etc.

Hydrogen refers to hydrogen, and/or a compound or compounds that when in the presence of a heavy oil feed and a catalyst react to provide hydrogen.

"Catalyst precursor" refers to a compound containing one or more catalytically active metals, from which compound the slurry catalyst is eventually formed, and which compound may be catalytically active as a hydroprocessing catalyst.

"One or more of" or "at least one of" when used to preface several elements or classes of elements such as X, Y and Z or $X_1$-$X_n$, $Y_1$-$Y_n$ and $Z_1$-$Z_n$, is intended to refer to a single element selected from X or Y or Z, a combination of elements selected from the same common class (such as $X_1$ and $X_2$), as well as a combination of elements selected from different classes (such as $X_1$, $Y_2$ and $Z_n$).

SCF/BBL (or scf/bbl) refers to a unit of standard cubic foot of gas ($N_2$, $H_2$, etc.) per barrel of hydrocarbon feed, or slurry catalyst, depending on where the unit is used.

The Periodic Table referred to herein is the Table approved by IUPAC and the U.S. National Bureau of Standards, an example is the Periodic Table of the Elements by Los Alamos National Laboratory's Chemistry Division of October 2001.

"Metal" refers to reagents in their elemental, compound, or ionic form. "Metal precursor" refers to the metal compound feed to the process. The term "metal" or "metal precursor" in the singular form is not limited to a single metal or metal precursor, i.e., Group VIB or promoter metals, but also includes the plural references for mixtures of metals. "In the solute state" means that the metal component is in a protic liquid form.

"Group VIB metal" refers to chromium, molybdenum, tungsten, and combinations thereof in their elemental, compound, or ionic form.

"Promoter metal" refers to a metal in its elemental, compound, or ionic form selected from any of Group IVB, Group VIII, Group IIB, Group IIA, Group IVA and combinations thereof. The Promoter metal increases the catalytic activity of the Primary metal, and is present in a smaller amount than the Primary metal.

"Group VIII metals" refers to iron, cobalt, nickel, ruthenium, rhenium, palladium, osmium, iridium, platinum, and combinations thereof.

1000° F.+ conversion rate refers to the conversion of a heavy oil feedstock having a boiling point of greater than 1000° F.+ to less than 1000° F. (538° C.) boiling point materials in a hydroconversion process, computed as: (100%*(wt. % boiling above 1000° F. materials in feed−wt. % boiling above 1000° F. materials in products)/wt. % boiling above 1000° F. materials in feed)).

"Dispersion" also known as "emulsion" in the context of slurry catalyst refers to two immiscible fluids in which one fluid (e.g., catalyst) is suspended or dispersed in the form of droplets in the second fluid phase (e.g., heavy oil feedstock or hydrocarbon diluent) as the continuous phase. In one embodiment, the droplets are in the range of 0.1 to 20 microns in size. In another embodiment, from 1 to 10 microns. The droplets can subsequently coalesce to be larger in size. Droplet size can be measured by methods known in the art, including particle video microscope and focused beam reflectance method, as disclosed in Ind. Eng. Chem. Res. 2010, 49, 1412-1418, the disclosure of which is herein incorporated in its entirety by reference.

Pore porosity and pore size distribution in one embodiment are measured using mercury intrusion porosimetry, designed as ASTM standard method D 4284. In another embodiment, pore porosity and size distribution are measured via the nitrogen adsorption method. Unless indicated otherwise, pore porosity is measured via the nitrogen adsorption method.

In one embodiment, the invention relates to a novel slurry catalyst system for use in heavy oil upgrade with improved properties including but not limited to high surface area/large pore volume, wherein the slurry catalyst system comprises in part a deoiled spent catalyst. The invention also relates to a method for the hydroconversion or upgrade of heavy oils, by sending the heavy oil feed to the upgrade process in the presence of the a slurry catalyst containing a deoiled spent catalyst.

Deoiled Spent Catalyst:

In one embodiment, the spent catalyst originates from a bulk (unsupported) Group VIB metal sulfide catalyst optionally promoted with at least a Promoter Metal selected from a Group VB metal such as V, Nb; a Group VIII metal such as Ni, Co; a Group VIIIB metal such as Fe; a Group IVB metal such as Ti; a Group IIB metal such as Zn, and combinations thereof. Promoter Metals are typically added to a catalyst formulation to improve selected properties, or to modify the catalyst activity and/or selectivity. In yet another embodiment, the spent catalyst originates from a dispersed (bulk or unsupported) Group VIB metal sulfide catalyst promoted with a Group VIII metal for hydrocarbon oil hydroprocessing. In another embodiment, the spent catalyst originates from a Group VIII metal sulfide catalyst. In yet another embodiment, the spent catalyst originates from a catalyst consisting essentially of a Group VIB metal sulfide. In one embodiment, the spent catalyst originates from a bulk catalyst in the form of dispersed or slurry catalyst. In another embodiment, the bulk catalyst is a colloidal or molecular catalyst.

Further details regarding the catalyst wherefrom the spent catalyst originates are described in a number of publications, including US Patent Publication Nos. US20110005976A1, US20100294701A1, US20100234212A1, US20090107891A1, US20090023965A1, US20090200204A1, US20070161505A1, US20060060502A1, and US20050241993A1, the relevant disclosures with respect to the catalyst are included herein by reference.

The bulk catalyst in one embodiment is used for the upgrade of heavy oil products as described in a number of publications, including U.S. Pat. No. 7,901,569, U.S. Pat. No. 7,897,036, U.S. Pat. No. 7,897,035, U.S. Pat. No. 7,708,877, U.S. Pat. No. 7,517,446, U.S. Pat. No. 7,431,824, U.S. Pat. No. 7,431,823, U.S. Pat. No. 7,431,822, U.S. Pat. No. 7,214,309, U.S. Pat. No. 7,390,398, U.S. Pat. No. 7,238,273 and U.S. Pat. No. 7,578,928; US Publication Nos. US20100294701A1, US20080193345A1, US20060201854A1, and US20060054534A1, the relevant disclosures are included herein by reference. In one embodiment, after being used in a hydroprocessing or heavy oil upgrade process, the spent catalyst has diminished catalytic activity compared to a fresh catalyst that has not been used in hydroprocessing. In one embodiment, the deoiled spent catalyst has less than 75% but more than 10% of its original catalytic activity. In another embodiment, the spent catalyst has more than 25% but less than 50% of the original catalytic activity.

After being used in hydroprocessing, the spent catalyst in one embodiment first undergoes "deoiling" treatment for the removal of hydrocarbons such as oil, precipitated asphaltenes, other oil residues and the like. The spent catalyst prior to deoiling contains carbon fines, metal fines, and (spent) unsupported slurry catalyst in unconverted resid hydrocarbon oil, with a solid content ranging from 5 to 50 wt. % in soluble hydrocarbons as unconverted heavy oil feedstock (resid). In another embodiment, the solid content is 10-15 wt. % catalyst in soluble hydrocarbons. In one embodiment, the treatment is a deoiling process for oil removal. In another embodiment, the deoiling process further comprises a subsequent liquid/solid separation step for the recovery of deoiled spent catalyst. The deoiling process in one embodiment employs a filtration process such as cross-flow filtration, dynamic filtration, microfiltration, and combinations thereof, which may or may not include the use of a solvent for the removal of heavy oil from the spent catalyst. In one embodiment, the filtration process employs at least a membrane, e.g., filtration equipment from VSEP Technology. In yet another embodiment, sedimentation is used in combination with a filtration process.

In one embodiment, the deoiling process comprises a number of separate sub-units including solvent wash (solvent extraction), filtration, sedimentation, drying, and solvent recovery sub-units. In one embodiment, the spent slurry catalyst is first combined with solvent to form a combined slurry-solvent stream prior to being filtered via membrane filtration. In another embodiment, the feedstock stream and the solvent are fed to the filter as separate feed streams wherein they are combined in the filtration process. The ratio of spent catalyst to solvent (as volume ratio) ranges from 0.10/1 to 100/1 (based on the spent catalyst slurry volume). In one embodiment, solvent is added in a volume ratio of 0.50/1 to 50/1. In another embodiment, solvent is added in a volume ratio ranging from 1:1 to 1:6 (solvent to heavy oil in the spent slurry catalyst).

In one embodiment in addition to the oil removal step, the spent catalyst treatment further includes a thermal treatment step, e.g., drying, calcination, and/or pyrolyzing, for removal of hydrocarbons from the spent catalyst. In one embodiment, the thermal treatment is under inert conditions, i.e., under nitrogen. In another embodiment, the drying temperature is at a sufficiently high temperature to decompose at least 90% of solvents and other compounds that may be bound to the spent catalyst particles. In yet another embodiment, the deoiling is with the use of a sub-critical dense phase gas, and optionally with surfactants and additives, to clean/remove oil from the spent catalyst.

The deoiling or removal of hydrocarbons from spent catalyst is disclosed in a number of publications, including U.S. Pat. No. 7,790,646, U.S. Pat. No. 7,737,068, WO20060117101, WO2010142397, US20090159505A1, US20100167912A1, US20100167910A1, US20100163499A1, US20100163459A1, US20090163347A1, US20090163348A1, US20090163348A1, US20090159505A1, US20060135631A1, and US20090163348A1, the relevant disclosures are included herein by reference.

In one embodiment after deoiling, at least 50% of the soluble hydrocarbons (e.g., heavy oil) in the spent catalyst is removed. In another embodiment, the removal rate is at least 75%. In a third embodiment, at least 90% of the soluble hydrocarbons in the spent catalyst is removed. The spent catalyst after deoiling in one embodiment contains less than 25 wt. % soluble hydrocarbons as unconverted resid. In a second embodiment, less than 10 wt. % hydrocarbons (on a solvent free basis). In a third embodiment, the deoiled spent catalyst has less than 1 wt. % soluble hydrocarbons (on a solvent free basis). In one embodiment after deoiling, the spent catalyst has less than 500 ppm soluble hydrocarbons in the form of residual solvents.

In one embodiment, after the oil removal process and after thermal treatment, the deoiled spent catalyst is in the form of a coke-like material. In yet another embodiment, the deoiled spent catalyst is the form of aggregate of particles, or clumps, than can be ground or crushed to the desired particle size, e.g., less than 20 microns, for subsequent incorporation into the slurry catalyst. The grinding or crushing can be done using techniques known in the art, e.g., via wet grinding or dry grinding, and using equipment known in the art including but not limited to hammer mill, roller mill, attrition mill, grinding mill, media agitation mill, etc.

The deoiled spent catalyst is characterized as having relatively high surface and pore volume, with the surface and pore volume characteristics varying depending on the residual catalytic activity and the amount of catalytic metal to heavy oil in the upgrade process where it was previously used. For example, a deoiled spent catalyst with 30% of original catalytic activity has lower surface area and pore volume compared to a deoiled spent catalyst with 75% of original catalytic activity. In another example, a deoiled spent catalyst with twice the amount of Mo (as wt. %) as a second deoiled spent catalyst is expected to have better surface area and pore volume.

In one embodiment, the deoiled spent catalyst has a surface area ranging from 0.5 to 100 $m^2/g$. In a second embodiment, from 5 to 40 $m^2/g$. In a third embodiment, from 20 to 80 $m^2/g$. The total pore volume (TPV) ranges from 0.02 to 0.5 cc/g in one embodiment; from 0.05 to 0.3 cc/g in another embodiment; and from 0.10 to 0.2 cc/g in a third embodiment. The mean particle size ranges from 1 to 100 μm (volume basis, sonic) in one embodiment; from 5 to 50 μm in a second embodiment. On a number basis, the mean particle size varies from 0.1 to 2 μm in one embodiment and 0.2 to 1 μm in a second embodiment.

Optional Contaminant Metal Removal:

After the oil removal process, the amount metals left in the deoiled spent catalyst depends on the compositional make-up of the catalyst for use in hydroprocessing, e.g., a sulfided Group VIB metal catalyst, a bimetallic catalyst with a Group VIB metal and a promoter Group VIII metal, or a multi-metallic catalyst with at least a Group VIB and at least a Promoter metal. In some embodiments, the deoiled spent catalyst may comprise contaminants previously present in the heavy oil feedstock being upgraded with the catalyst. Examples of contaminants include but are not limited to Ni, Fe, V, Mg, Ca, etc. Depending on the catalyst concentration in the heavy oil upgrade process, its composition, the upgrade operations, as well as the properties of the heavy oil feedstock being used, in one embodiment, the deoiled spent catalyst contains at least 1 wt. % of metal contaminants in the form of vanadium primarily in either oxide or sulfide form. In another embodiment, the deoiled spent catalyst contains at least 1 wt. % nickel. In another embodiment, the amount of contaminants such as vanadium ranges from 2 to 10 wt. %. In yet another embodiment, the amount of vanadium for removal/pre-treatment of the deoiled spent catalyst is at least 3 wt. %.

Removal or passivation of contaminant metals such as vanadium is helpful in maintaining catalyst performance in heavy oil upgrade. Without being bound by theory, it is believed that metal contaminants from petroleum feed cover pores or sites in a catalyst, which may reduce the catalytic activity of or eventually deactivate a catalyst feed.

In one embodiment after deoiling (with or without thermal treatment), the deoiled spent catalyst is treated for the removal of contaminants After treatment, the concentration of vanadium, a contaminant, is reduced by at least 20% in one embodiment; at least 40% in a second embodiment; and at least 50% in a third embodiment. In a third embodiment after treatment, the concentration of vanadium is reduced to less than 500 ppm. In a fourth embodiment, the reduced concentration of vanadium is less than 200 ppm.

In one embodiment, the treatment is with a treating solution, with the volume ratio of treating solution to deoiled spent catalyst ranging from 2:1 to 100:1, with the deoiled spent catalyst being "washed" upon contact with the treating solution to remove the contaminants. The treatment can be a single wash, or a multi-cycled wash, with the deoiled spent catalyst being treated with the same treating solution multiple times (recycled), a fresh treating solution for every wash cycle, or a different fresh treating solution for each wash cycle.

The washing is carried out by soaking in the treatment solution or mixing with the treatment solution in a mixing tank for at least 5 minutes in one embodiment, at least 30 minutes in a second embodiment, at least 1 hour in a third embodiment, and from a period of 2 to 5 hours in a fourth embodiment. In yet another embodiment, the treating or washing can be carried out in a continuously operated, counter-current washing unit. The washing is ambient temperature in one embodiment, 50° F. in a second embodiment, and at least 100° F. in a third embodiment.

In one embodiment with a deoiled spent catalyst containing vanadium oxide as a metal contaminant, the treating (washing) solution is plain water. In another embodiment, the treating solution comprises at least an inorganic mineral acid with a relatively high ionization constant such as sulfuric acid, hydrochloric acid, phosphoric acid, nitric acid, etc. In one embodiment, the acid has a strength ranging from 0.2 to 12.0 normal.

In one embodiment for a deoiled spent catalyst with vanadium sulfide as a metal contaminant, the washing solution comprises at least an oxidizing agent or oxidant in an aqueous form. Examples of oxidizing agents include halogens, oxides, peroxides and mixed oxides, including oxyhalites, their acids and salts thereof. Suitable oxidizing agents also include active oxygen-containing compounds, for example ozone. In one embodiment, the treating solution comprises hydrogen peroxide in the form of an aqueous solution containing 1% to 60% hydrogen peroxide (which can be subsequently diluted as needed). In yet another embodiment, the treating solution comprises hypochlorite ions ($OCl^-$ such as NaOCl, $NaOCl_2$, $NaOCl_3$, $NaOCl_4$, $Ca(OCl)_2$, $NaClO_3$, $NaClO_2$, etc. In one embodiment, the amount of oxidizing agents/oxidants used is at least equal to the amount of metal contaminants to be removed on a molar basis, if not in an excess amount.

In one embodiment, the treating solution is selected depending on the source of the spent catalyst. In some embodiments with a spent catalyst containing vanadium oxide which is slightly soluble in water, water can be selected as the treating solution to dissolve and remove vanadium oxide. Aqueous acid solution can also be used for removing vanadium contaminants with minimal removal of other metals in the sulfide form. In other embodiments with metal contaminants existing as vanadium sulfide, an oxidizing agent can be used as the treating solution to first oxidize the vanadium sulfide for subsequent removal with water or non-oxidizing acid water.

In one embodiment, the washing is via a multi-step treatment, e.g., the deoiled spent catalyst is first treated with in a reductive wash with an aqueous solution of a reducing agent such as sulfur dioxide, oxalic acid, carbon monoxide or the like. The reductive wash is followed by an oxidative wash with an aqueous solution of the likes of an organic peroxide, hydrogen peroxide, ozone or a perchlorate. In another embodiment, the deoiled spent catalyst is first treated with an oxygen-containing gas, then followed by a water wash to remove any oxidized metal contaminants. After treatment, the deoiled catalyst fines cluster or settle by gravity to the bottom portion of the treatment tank, wherein the treating solution can be withdrawn/removed and subsequently separated from the deoiled spent catalyst.

Fresh Catalyst Portion:

In one embodiment, a fresh catalyst is employed in addition to the deoiled spent catalyst, constituting the slurry catalyst feed to the heavy oil upgrade system. The fresh catalyst in one embodiment is an active (sulfided) catalyst in a hydrocarbon oil diluent, in the form of a slurry with dispersed particles or clumps of particles. In another embodiment, the fresh catalyst portion comprises a sulfided water-based catalyst precursor, which can be subsequently mixed with a hydrocarbon diluent and the deoiled spent catalyst, forming an oil based slurry catalyst. Examples of hydrocarbon oil diluents include VGO (vacuum gas oil), naphtha, MCO (medium cycle oil), light cycle oil (LCO), heavy cycle oil (HCO), solvent donor, or other aromatic solvents, etc., in a weight ratio ranging from 1:1 to 1:20 of catalyst to diluent.

In one embodiment, the fresh slurry catalyst comprises a sulfided catalyst having at least a Group VIB metal, or at least a Group VIII metal, or at least a group IIB metal, e.g., a ferric sulfide catalyst, zinc sulfide, nickel sulfide, molybdenum sulfide, or an iron zinc sulfide catalyst, with a concentration of 200 ppm to 2 wt. % metal as a wt. % of heavy oil feedstock. In another embodiment, the concentration of metal ranges from 500 ppm to 3 wt. %. In another embodiment, the fresh catalyst portion comprises a multi-metallic catalyst comprising at least a Group VIB metal and at least a Group VIII metal (as a promoter), wherein the metals may be in elemental form or in the form of a compound of the metal. In one example, the fresh catalyst portion comprises a $MoS_2$ catalyst promoted with at least a group VIII metal compound.

In one embodiment, the fresh slurry catalyst has an average particle size of at least 1 micron. In another embodiment, the fresh slurry catalyst has an average particle size in the range of 1-20 microns. In a third embodiment, the fresh slurry catalyst has an average particle size in the range of 2-10 microns. In one embodiment, the fresh slurry catalyst particle comprises aggregates of catalyst molecules and/or extremely small particles that are colloidal in size (e.g., less than 100 nm, less than about 10 nm, less than about 5 nm, and less than about 1 nm). In yet another embodiment, the fresh slurry catalyst comprises aggregates of single layer $MoS_2$ clusters of nanometer sizes, e.g., 5-10 nm on edge. In operations, the colloidal/nanometer sized particles aggregate in a hydrocarbon diluent, forming a slurry catalyst with an average particle size in the range of 1-20 microns.

In one embodiment, at least 30% of the fresh slurry catalyst has pore sizes >100 Angstroms in diameter. In another embodiment, at least 40%. In yet another embodiment, at least 50% are in the range of 50 to 5000 Angstrom in diameter. In one embodiment, the fresh slurry catalyst has a total pore volume (TPV) of at least 0.1 cc/g. In a second embodiment, a TPV of at least 0.2 cc/g. In one embodiment, the fresh slurry catalyst as a surface area of at least 100 $m^2/g$. In one embodiment, the surface area is at least 200 $m^2/g$. In another embodiment, the surface area is in the range of 200 to 900 $m^2/g$.

Details regarding the fresh catalyst and methods for preparation thereof can be found in U.S. Pat. Nos. 7,947,623, 7,678,730, 7,678,731, 7,737,072, 7,737,073, 7,754,645, 7,214,309, 7,238,273, 7,396,799, and 7,410,928; US Patent Publication Nos. US20100294701A1, US20090310435A1, US20060201854A1, US20110190557A1; and US20050241993A1; and PCT Patent Publication No. WO2011091219, the relevant disclosures are included herein by reference.

Forming Slurry Catalyst Feed:

In one embodiment, the deoiled spent catalyst is first slurried or reconstituted in a hydrocarbon diluent, forming a slurry with dispersed particles or clumps of particles, then fed to a heavy oil upgrade system as a separate feed stream from the fresh slurry catalyst. The separate feed system allows for the tailoring or proportioning of fresh slurry catalyst to deoiled spent catalyst. In yet another embodiment, the deoiled spent catalyst (in hydrocarbon diluent) is added directly to a fresh slurry catalyst (in hydrocarbon diluent), forming a single slurry catalyst feed stream for use in heavy oil upgrade. In yet a third embodiment, the deoiled spent catalyst can be mixed with the sulfided water-based catalyst precursor prior to the transformation step, forming a slurry catalyst. In another embodiment, the mixing of the deoiled spent catalyst and the sulfided water-based catalyst precursor is after the transformation step. In a fifth embodiment, the feed system can be flexible with fresh catalyst being provided as the sole feed source at first, then the deoiled spent catalyst is subsequently introduced as part of the total slurry catalyst feed to the system after the system is in operation for a period of time. In yet another embodiment with a flexible feed, the deoiled spent catalyst is provided to some but not all reactors in the system, on a continuous or intermittent basis, at the same or different rates to the different reactors in the system, all depending on the operating conditions of the system and the desired results.

In one embodiment, the deoiled spent catalyst is first "reconstituted" (or "slurried") with the addition of a diluent such as a hydrocarbon oil feed, e.g., VGO (vacuum gas oil), naphtha, MCO (medium cycle oil), light cycle oil (LCO), heavy cycle oil (HCO), solvent donor, or other aromatic solvents, etc., in a weight ratio ranging from 1:1 to 1:25 of deoiled spent catalyst to diluent, forming a slurry with the mixing of the deoiled spent catalyst with the hydrocarbon diluent. In another embodiment, the ratio of deoiled spent catalyst to hydrocarbon diluent ranges from 1:3 to 1:20. In a third embodiment, the ratio of deoiled spent catalyst to hydrocarbon diluent ranges from 1:5 to 1:10. The reconstituted stream can be added as part of the slurry catalyst feed to a heavy oil upgrade system as a separate feed stream, or combined with a fresh catalyst as a single feed stream.

The amount of deoiled spent catalyst to fresh slurry catalyst varies depending on a number of factors, including but not limited to the properties of the heavy oil feedstock amongst other process variables. In one embodiment, a sufficient amount of deoiled spent catalyst is employed for a ratio of fresh slurry catalyst to deoiled spent catalyst from 1:5 to 5:1 (on a dry basis based on total solid catalyst weight to the system). In another embodiment, the amount of deoiled spent catalyst ranges from 20 to 75% of total slurry catalyst to the heavy oil upgrade system (on a dry basis). In a third embodiment, the amount ranges from 30 to 66%. In a fourth embodiment, the amount of deoiled spent catalyst is at least 10% of the total slurry catalyst feed to the system.

The total amount of slurry catalyst feed to the heavy oil upgrade system varies from a slurry catalyst concentration of at least 500 wppm to 3 wt. % (based on amount of the Primary catalyst metal in the slurry catalyst, fresh and deoiled, to heavy oil feedstock ratio). In one embodiment, the total amount of slurry catalyst is added to the feedstock for a primary catalyst metal to oil rate of 0.01 to 3 wt. %. In a second embodiment, at a rate of 0.15 to 2 wt. %. In a third embodiment, at a rate of 1000 to 4000 ppm Primary metal, e.g., a Group VIB metals such as molybdenum. In a fourth embodiment, the catalyst feed is added to the heavy oil feedstock at a sufficient rate for the total amount of Primary metal in the reaction zone reaches 0.05 to 0.5 wt. % (catalyst metal in the slurry catalyst as a percent of the total weight of the feedstock).

The slurry catalyst (whether the fresh catalyst itself, the reconstituted spent catalyst, or a mixture of both) comprises a dispersed suspension of particles in a hydrocarbon diluent or medium. The hydrocarbon medium can be a heavy oil feedstock itself; a hydrocarbon transforming agent (diluent) such as VGO, naphtha, MCO, LCO, HCO, solvent donor, or other aromatic solvents, etc., and mixtures thereof; or a mixture of heavy oil feedstock and a hydrocarbon diluent. The mixing with the hydrocarbon medium in one embodiment is under high shear mixing to generate an emulsion catalyst.

In one embodiment, the slurry catalyst with deoiled spent catalyst and fresh catalyst comprises a plurality of suspended or dispersed droplets in solution ("emulsion catalyst") with the droplets having a mean size of 0.005 to 500 microns. In a second embodiment, the dispersed particles or droplets have an average droplet size of 0.01 to 100 microns. In a third embodiment, an average droplet size of 0.5 to 50 microns. In a fourth embodiment, an average droplet size of 1 to 30 microns. In a fifth embodiment, a size of 5 to 20 microns. In a sixth embodiment, an average droplet size in the range of 0.3 to 20 μm. In a seventh embodiment, an average droplet size ranging from 0.10 to 50 microns.

In one embodiment, the slurry catalyst comprises a plurality of dispersed particles in a hydrocarbon medium, wherein the dispersed particles have a mean particle size ranging from 0.05 to 100 microns. In another embodiment, the particles have a mean particle size ranging from 0.1 to 100 microns. In yet another embodiment, a mean particle size of less than 40 microns. In one embodiment, the slurry catalyst has a mean particle size ranging from colloidal (nanometer size) to about 1-2 microns. In another embodiment, the catalyst comprises catalyst molecules and/or extremely small particles, forming a slurry catalyst with "clusters" of colloidal particles having an average particle size in the range of 1-20 microns.

In one embodiment, the slurry catalyst with deoiled spent catalyst and fresh catalyst is characterized as having a polymodal pore distribution with at least a first mode having at least about 80% pore sizes in the range of 5 to 2,000 Angstroms in diameter, a second mode having at least about 70% of pore sizes greater in the range of 5 to 1,000 Angstroms in diameter, and a third mode having at least 20% of pore sizes of at least 100 Angstroms in diameter. As used herein, polymodal includes bimodal and higher modal. In one embodiment, at least 20% of pore sizes are >100 Angstroms in diameter. In another embodiment, at least 30%.

In one embodiment, the slurry catalyst with a total concentration of at least 4000 ppm (as catalyst metals in heavy oil feed) having at least 25% deoiled spent catalyst is characterized as having an increase in pore volume (over 100 Angstroms) of at least 20% over a catalyst without any deoiled spent catalyst and the same concentration of catalyst metals. For a slurry catalyst with at least 50% deoiled spent catalyst, the increase in PV (>100 Angstrom) is at least 40% over a comparable catalyst feed without any spent catalyst.

Heavy Oil Upgrade System.

The slurry catalyst feed with deoiled spent catalyst can be used in hydroprocessing processes to treat a plurality of heavy oil feedstock under wide-ranging reaction conditions such as temperatures from 200 to 450° C., hydrogen pressures from 5 to 300 bar (72 to 4351 psi or 0.5 to 30 MPa), liquid hourly space velocities from 0.05 to 10 $h^{-1}$ and hydrogen treat gas rates from 35 to 2670 $m^3/m^3$ (200 to 15000 SCF/B), with the fresh slurry catalyst and the deoiled spent catalyst being fed to the process as separate feed streams, or as a single feed stream.

The hydroprocessing (or hydrocracking) can be practiced in one or more reaction zones and can be practiced in either countercurrent flow or co-current flow mode, where the feed stream flows counter-current to the flow of hydrogen-containing treat gas. In one embodiment, the hydroprocessing also includes slurry and ebullated bed hydrotreating processes for the removal of sulfur and nitrogen compounds. In one embodiment, the upgrade system includes a plurality of reaction zones (reactors) and at least a separation zone (separator). The deoiled spent catalyst can be supplied to only one reactor such as the first reactor, or it can be fed to different reactors in the system, as a continuous feed, or intermittently depending on the operation.

In the reactors under hydrocracking conditions, at least a portion of the heavy oil feedstock is converted to lower boiling hydrocarbons, forming upgraded products. The mixture of upgraded products, the spent slurry catalyst, the hydrogen containing gas, and unconverted heavy oil feedstock is sent to the next reactor in series, which is also maintained under hydrocracking conditions. In the next reactor with additional hydrogen containing gas feed and optionally with additional heavy oil feedstock, at least a portion of the heavy oil feedstock is converted to lower boiling hydrocarbons, forming additional upgraded products.

In some embodiments before going to the next reactor in series (or after the last reactor in series), the mixture exiting the reactor is sent to a separator (separation zone), whereby the upgraded products are removed with the hydrogen containing gas as an overhead stream, and the spent slurry catalyst and the unconverted heavy oil feedstock are removed as a non-volatile stream.

In one embodiment, water (and/steam) is added to at least one of the reactors (or all the reactors) in the system in ratio of 1 to 25 wt. % of the heavy oil feedstock. The water can be added separately or to the catalyst feed system, in combination with the deoiled spent catalyst slurry and/or the fresh catalyst slurry. It is believed that the presence of the water in the process favorably reduces heavy metal deposit.

It should be noted that the use of deoiled spent slurry catalyst does not preclude incorporating spent catalyst (but not deoiled) in a recycled stream as a feed to the heavy oil upgrade system. The recycled stream herein comprises at least a portion of the non-volatile stream from at least one of the separation zones in the heavy oil upgrade system, e.g., from an ISF (interstage flash unit) or from a separation zone after the last reactor in the system, and/or an interstage deasphalting unit. In one embodiment, the recycled stream is sent one of the reactors in the system as part of the feed to control the heavy metal deposits. The recycled stream ranges between 3 to 50 wt. % of total heavy oil feedstock to the process; 5 to 35 wt. % in a second embodiment; at least 10 wt. % in a third embodiment; at least 35 wt. % in a fourth embodiment; and 35 to 50 wt. % in a fifth embodiment. The recycled stream comprises non-volatile materials from the last separation zone in the system, containing unconverted materials, heavier hydrocracked liquid products, slurry catalyst, small amounts of coke, asphaltenes, etc. The recycled stream contains between 3 to 30 wt. % spent slurry catalyst in one embodiment; 5 to 20 wt. % in a second embodiment; and 1 to 15 wt. % in a third embodiment.

Details regarding operations of the hydroprocessing reactors in heavy oil upgrade can be found in U.S. patent application Ser. Nos. 13/103,790, 12/506,840, 12/233,393, 12/233,439, 12/212,737; U.S. Pat. Nos. 7,943,036; 7,931,797; 7,897,036; 7,938,954; 7,935,243; 7,943,036; 7,578,928; and US Patent Publication Nos. 2011-0017637 and 2009-0008290, the relevant disclosures are included herein by reference.

The deoiled spent catalyst can be added to the upgrade system as an additional or supplemental feed stock, i.e., added to an upgrade system with the regular dosage of fresh catalyst feed at a rate of 0.10× to 3× the fresh catalyst feed to help reduce the build-up of metal contaminants. In another embodiment, the deoiled spent catalyst can be added as a replacement feed, allowing the amount of fresh catalyst feed in the regular dosage to be reduced, with the deoiled spent catalyst being supplied at a rate ranging from 1× to 5× of the fresh catalyst feed that it replaces, depending on the retained catalytic level of the deoiled spent catalyst. The replacement or supplemental feed can be on a long-term continuous basis, or on a short-term basis to temporarily reduce or relieve deposit build-up in the system.

In one embodiment, the slurry catalyst feed system with deoiled spent catalyst is characterized as giving excellent conversion rates in heavy oil upgrade, i.e., giving a 1000° F.+ conversion of at least 50% in the upgrade of a heavy oil having an API of at most 15, when applied at less than 1 wt. % Primary metal such as a Group VIB (wt. % relative to heavy oil feedstock), a 1000° F.+ conversion of at least 75% in a second embodiment, a 1000° F.+ conversion of at least 80% in a third embodiment, and at least 90% in a fourth embodiment.

In one embodiment, a heavy oil upgrade system with additional deoiled spent catalyst as part of the feed system is characterized as having less contaminants/metal deposit in the reactor system, e.g., build-up of metal contaminants such as vanadium. It is believed that the deoiled spent catalyst provides additional surface area to trap contaminants while still offering left-over catalytic activity. The additional surface area in the deoiled spent catalyst traps at least a contaminant such as vanadium, the trapped vanadium is then removed from the reactor system as spent catalyst, thus reducing the amount of vanadium deposit left in the upgrade system. In addition to the reduction in deposit build-up, the deoiled spent catalyst helps reduce cost with the fresh catalyst being replaced with the less expensive spent catalyst.

In one embodiment of a heavy oil upgrade system with deoiled spent catalyst as a supplemental feedstock, e.g., having an additional 25% of the catalyst feed in the form of deoiled spent catalyst, is expected to have at least 5% reduction in vanadium build-up and with the same or better conversion rates, as compared to an upgrade system with no additional deoiled spent catalyst in the feed (and the same amount of fresh catalyst in the heavy oil feedstock). In another embodiment with a feed system comprising deoiled spent catalyst to fresh catalyst at a weight ratio of at least 2:1, with the Primary metal concentration of the fresh slurry catalyst is at least 1000 ppm (wt. % of metal to heavy oil feedstock), the reduction in vanadium build up is at least 10% for a comparable conversion rate, compared to an upgrade system with the same amount of fresh catalyst only.

In one embodiment of a heavy oil upgrade system with deoiled spent catalyst as a replacement feedstock and with a Primary metal concentration in the catalyst feed system of at least 1000 ppm, the deoiled spent catalyst is provided at a rate of at least 2× the amount of the fresh catalyst it replaces for a reduction of metal build up of at least 5% at comparable conversion rates. In another embodiment with a replacement feed rate of 3× (deoiled spent catalyst to fresh catalyst being replaced), the reduction in metal build up is at least 10%.

Reference will be made to the figures with block diagrams schematically illustrating different embodiments of a process for making a slurry catalyst with a deoiled spent catalyst for heavy oil upgrade.

FIG. 1 schematically illustrates various embodiments of a hydroconversion process with a slurry catalyst feed including a deoiled spent catalyst. In the process to upgrade a heavy oil feedstock, fresh catalyst feed is made in a synthesis unit 10 and supplied directly to the reactor 20 as a separate feed stream 12. In another embodiment, the fresh catalyst feed can also be made off-site or commercially purchased and supplied as feed stream 21. In the embodiment as shown, heavy oil feedstock is fed as a separate feed stream 25. In other embodiments (not shown), the heavy oil feed can be combined with the fresh slurry catalyst feed, and/or the deoiled spent catalyst feed, and/or a recycled stream containing spent catalyst and unconverted heavy oil as a single feed stream to the reactor 20.

From the heavy oil upgrade system 20, spent catalyst 22 undergoes a deoiling step 30, wherein at least 50% of the soluble hydrocarbons are removed. The deoiled spent catalyst can be incorporated into the slurry catalyst feed system as feed stream 24. In one embodiment, the deoiled spent catalyst is first thermally treated in dryer 40 before being sent to the reactor as feed stream 41. In another embodiment, after drying, the deoiled spent catalyst 42 is calcined in calcination unit 50. In yet another embodiment, deoiled spent catalyst 33 is fed directly to calciner 50, then sent to upgrade reactor as feed stream 51. Although not shown, the deoiled spent catalyst is first slurried in a hydrocarbon diluent prior to being fed to the reactor 20. The slurried deoiled catalyst can be fed to the reactor system as a separate feed stream 24, combined with the fresh slurry catalyst 11 as a single feed stream 23, or combined with the heavy oil feedstock as a single feed stream (not shown).

Figure 2:
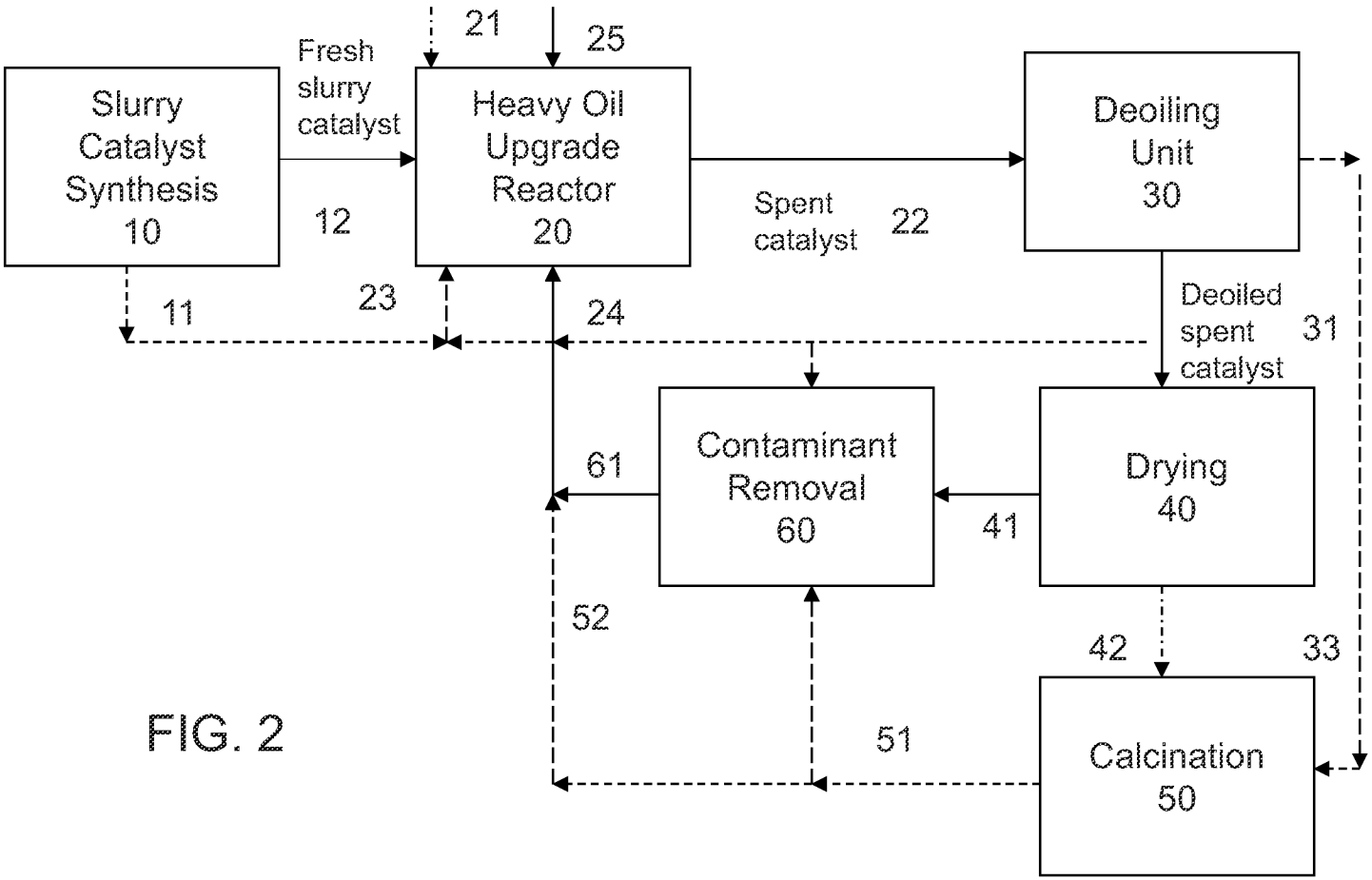
FIG. 2 shows a scheme with different embodiments of a hydroconversion process to upgrade heavy oil, wherein the deoiled spent catalyst is first treated to remove contaminants.

FIG. 2 shows a scheme wherein the deoiled spent catalyst is first treated to remove contaminants. In this embodiment, at least some or all of the deoiled spent catalyst is sent to treatment unit 60, wherein undesirable contaminants such as vanadium can be removed with a treating agent, a water wash, a treatment solution containing at least a mineral acid, an oxidizing agent or an oxidant, or combinations of the above treatment methods. The treatment step 60 further comprises a separation step (not shown), wherein the deoiled spent catalyst is separated from the treatment agent. Although not shown, after treatment, the deoiled spent catalyst can be dried in a dryer or thermally treated in a calciner, before it is slurried in a hydrocarbon diluent. The slurried treated/deoiled spent catalyst can be fed to the upgrade reactor system as a separate feed stream, or combined with the fresh slurry catalyst and/or the heavy oil feedstock as a single feed stream.

EXAMPLES

The following illustrative examples are intended to be non-limiting. VR refers to "vacuum resid" or a heavy oil feedstock. In the examples, the heavy oil feedstock VR1 contains 20.8 wt % microcarbon residue (MCR), 10.7 wt % hot heptane asphaltenes (HHA), 1.86 wt % sulfur, 1.2 wt % nitrogen, 150 ppm vanadium, 146 ppm nickel, and 4.8 degrees of API at 60° F. The heavy oil feedstock VR2 contains 29.9 wt. % microcarbon residue (MCR), 25.7 wt. % hot heptane asphaltenes (HHA), 5.12 wt. % sulfur, 0.79 wt % nitrogen, 672 ppm vanadium, 142 ppm nickel and 2.7 degrees of API at 60° F.

Example 1

A Ni—Mo slurry catalyst as described in U.S. Pat. Nos. 7,737,072 and 7,737,073 was used in a heavy oil upgrade process as described in U.S. Pat. No. 7,390,398. The catalyst was used at a high concentration of Mo relatively to VR feed (4 wt. % Mo to VR), so it is "lightly-deactivated" with ~50% of the original catalytic activity (relative to a fresh catalyst). The spent catalyst underwent a deoiling step similar to the procedures described in US Patent Publication No. 20100163499, employing a combination of sedimentation and a cross-filtration system wherein a solvent is added to the filtration feed stream, generating a deoiled solids coke product containing metal sulfides. The deoiled spent catalyst was slurried in VGO or VGO-based fresh slurry catalyst, at a VGO to deoiled spent catalyst weight ratio of 2:1 to 20:1, forming a slurried catalyst ("SCS" or spent catalyst slurry).

Example 2

A second Ni—Mo deoiled spent catalyst was generated as in Example 1, except that the catalyst was employed at a low concentration of Mo relative to heavy oil feed (0.5 wt. % Mo to VR), retaining less than ~⅓ of the original catalytic activity. Table 1 summarizes the properties and characteristics of the deoiled spent catalyst samples. The deoiled spent catalyst was slurried in VGO or VGO-based fresh slurry catalyst, at a VGO to deoiled spent catalyst weight ratio of 2:1 to 20:1, forming a slurried catalyst ("SCS" or spent catalyst slurry).

TABLE 1

| | Example 1 | Example 2 |
|---|---|---|
| Composition | | |
| Mo, wt % | 39.27 | 30.37 |
| Ni, wt % | 4.05 | 3.56 |
| V, wt % | 0.66 | 2.91 |
| C, wt % | 23.35 | 34.28 |
| Porosimetry | | |
| SA, $m^2/g$ | 33.11 | 9.14 |
| TPV, cc/g | 0.137 | 0.065 |
| PV (>100 Å), cc/g | 0.109 | 0.062 |
| Particle Size Distribution | | |
| Mean Dp (volume-basis, sonic), μm | 8.2 | 29.0 |
| Mean Dp (number-basis, sonic), μm | 0.27 | 0.72 |

Example 3

A third Ni—Mo deoiled spent catalyst was generated as in Example 1, an analysis of the spent catalyst solid shows 24.91 wt. % Mo, 4.42 wt. % Ni, and 6.22 wt. % V (primarily oxide form).

Example 4

Another Ni—Mo deoiled spent catalyst was generated as in Example 1, an analysis of the spent catalyst solid shows 20.55 wt. % Mo, 3.52 wt. % Ni, and 9.98 wt. % V (primarily sulfide form).

Example 5

The deoiled spent catalyst of Examples 3 and 4 were washed with water at a ratio of 1:30 spent catalyst to water (by weight). After filtration, analysis showed that 21% vanadium was removed from Example 3 sample and 1% of vanadium was removed from Example 4 sample.

Example 6

The deoiled spent catalyst of Example 3 was washed with $H_2SO4$ solution at 1:30 weight ratio at a molar ratio $H_2SO_4$ to V of 2.0. With the use of acid as the treating solution to increase the solubility of vanadium oxide, 47% of vanadium was removed. The deoiled spent catalyst of Example 4 was also treated $H_2SO4$ solution under the same condition, only 1% was removed.

Example 7

The deoiled spent catalyst of Example 4 was treated with 1.2 wt % hydrogen peroxide solution at 1:30 wt ratio. After filtration, the analysis showed that 44% of vanadium was removed from the deoiled spent catalyst by hydrogen peroxide (instead of only 1 wt % of removal by water or sulfuric acid solution).

Example 8

The spent catalyst of Example 3 was washed with water at a ratio of 1:30 spent catalyst to 0.9% $H_2SO_4$ aqueous solution (by weight). After filtration, an analysis of the filtrate showed 10.5 ppm Mo, 121 ppm Ni, and 131 ppm V, indicating that contaminant metals in the spent catalyst can be removed by washing with water with 17% V removal.

Example 9

In this example, 9000 grams of ammonium dimolybdate (ADM) solution (12% Mo) was heated to 750 RPM, 150° F. and 400 PSIG. To this heated ADM solution, a gas stream comprising 20% $H_2S$, 20% $CH_4$, 60% $H_2$ was bubbled through the solution until the S/Mo atomic=3.4. After the $H_2S$ addition, then an appropriate amount of nickel sulfate solution (8% Ni) was added to the mixture for a Ni/Mo wt % of ~10%. The product can be transformed to an oil base catalyst as in Comparative Example 1 on a batch basis, or a continuous basis. The resulting water-based catalyst was transformed to a fresh slurry catalyst, e.g., an oil-based catalyst with vacuum gas oil (VGO) and hydrogen in a pressure test autoclave in situ, at a VGO to catalyst weight ratio of 2:1.

Example 10

In this example, another fresh slurry catalyst is provided. 9000 grams of ADM solution (12% Mo) was heated to 750 RPM, 150 F and 400 PSIG. To this heated solution, a gas stream comprising 20% H2S, 20% CH4, 60% H2 was bubbled through the solution until the S/Mo atomic=3.4. After the $H_2S$ addition, then an appropriate amount of nickel sulfate solution (8% Ni) was added to the mixture for a Ni/Mo wt % of ~23%. The rest of the procedures and tests were similar to Example 9 to transform the catalyst to an oil-based catalyst.

Example 11

Different slurry catalyst samples were made by adding the deoiled spent catalyst from Example 1 ("SCS 1" or spent catalyst slurry) with the fresh slurry catalyst from Example 9 ("FCT" or fresh catalyst"). Table 2 lists the catalyst dosage for fresh catalyst and deoiled catalyst of the slurry catalyst feed mixtures:

TABLE 2

| | Mo from FCT, ppm | Mo from SCS, ppm |
|---|---|---|
| 100% Ex. 9 FCT | 4000 | 0 |
| 25% SCS 1 - 75% FCT Ex. 9 | 3000 | 1000 |
| 50% SCS 1 - 50% FCT Ex. 9 | 2000 | 2000 |
| 79% SCS 1 - 21% FCT Ex. 9 | 2000 | 7500 |

Example 12

Different slurry catalyst samples were made by adding the deoiled spent catalyst from Example 2 ("SCS 2" or spent catalyst slurry) with the high Ni fresh slurry catalyst from Example 10 ("FCT High Ni"). Table 3 lists the catalyst dosage for fresh catalyst and deoiled catalyst of the slurry catalyst feed mixtures:

TABLE 3

| | Mo from FCT, ppm | Mo from SCS, ppm |
|---|---|---|
| FCT Hi-Ni (Base Case 1) | 6000 | 0 |
| FCT Hi-Ni (Base case 2) | 3000 | 0 |
| 25% SCS 2 - 75% FCT Hi-Ni | 4500 | 1500 |
| 50% SCS 2 - 50% FCT Hi-Ni | 3000 | 3000 |

Examples 13-16

Catalyst samples from Example 11 were tested in a continuous flow unit with three 1-gallon continuous stirring tank reactors (CSTRs) in series. VR Liquid Hourly Space Velocity (LHSV) and reaction temperature are listed in Table 4. The VR feed was VR1.

Table 4 compares the heavy oil upgrade performance using a fresh slurry catalyst (standard Mo-only of Example 9) vs. slurry catalyst feed systems containing deoiled spent catalyst prepared in Example 11. The slurry catalyst feed examples with deoiled spent catalyst showed excellent metal removal characteristics, as indicated by low V trapping. V trapping is measured as total vanadium not recovered from (coming out of) the system vs. total vanadium fed into the system. A low percentage is more desirable, meaning less contaminant is trapped in the reactor. It should be noted that in Example 16, keeping the fresh Mo dosage at 2000 ppm and increasing the spent catalyst dosage to 7500 ppm Mo, the catalytic conversion (HDS, and HDN) increased by 4-6% as compared to Example 15 with a 50/50 fresh catalyst to deoiled spent catalyst ratio.

TABLE 4

| | Example 13 Comparative | Example 14 | Example 15 | Example 16 |
|---|---|---|---|---|
| Catalyst | 100% Ex. 9 FCT | 25% SCS 1 - 75% FCT Ex. 9 | 50% SCS 1 - 50% FCT Ex. 9 | 79% SCS 1 - 21% FCT Ex. 9 |
| VR1 LHSV | 0.125 | 0.125 | 0.125 | 0.125 |
| Avg. Rx Temp., F. | 819.5 | 819.5 | 819.3 | 820.0 |
| Mo from FCT, ppm | 4000 | 3000 | 2000 | 2000 |
| Mo from SCS, ppm | 0 | 1000 | 2000 | 7500 |
| **Conversion** | | | | |
| Sulfur, % | 85.94 | 85.80 | 85.75 | 89.80 |
| Nitrogen, % | 35.81 | 33.60 | 34.07 | 41.39 |
| MCR, % | 76.98 | 76.61 | 76.58 | 77.58 |
| VR (1000 F+), % | 91.88 | 91.26 | 91.55 | 91.37 |
| **Metal trapping** | | | | |
| V trapping | 14% | 5% | 11% | 0% |

Examples 17-20

Catalyst samples from Example 12 were tested in a continuous flow unit with three 1-gallon continuous stirring tank reactors (CSTRs) in series. VR Liquid Hourly Space Velocity (LHSV) and reaction temperature are listed in Table 5. The VR feed was VR2.

Table 5 compares the heavy oil upgrade performance using a fresh slurry catalyst (high Ni Mo—Ni of Example 10) vs. slurry catalyst feed systems of Example 12, containing deoiled spent catalyst. The slurry catalyst feed examples with deoiled spent catalyst showed excellent metal removal characteristics as indicated by very low V trapping, even for deoiled spent catalyst with little catalytic activity (<⅓ original catalytic activity for SCS 2). Additionally, it is noted that the use of deoiled spent catalyst still allows for excellent HDS and HDN activity with less fresh catalyst feed requirements.

TABLE 5

| | Example 17 Comparative | Example 18 Comparative | Example 19 | Example 20 |
|---|---|---|---|---|
| Catalyst | Std. Hi-Ni (Base Case 1) | Std. Hi-Ni (Base Case 2) | 25% SCS 2 - 75% FCT Hi-Ni | 50% SCS 2 - 50% FCT Hi-Ni |
| VR2 LHSV | 0.10 | 0.10 | 0.10 | 0.10 |
| Avg. Rx Temp., F. | 818.7 | 818.5 | 818.7 | 818.6 |
| Mo from FCT, ppm | 6000 | 3000 | 4500 | 3000 |
| Mo from SCS, ppm | 0 | 0 | 1500 | 3000 |
| **Conversion** | | | | |
| Sulfur, % | 91.42 | 88.81 | 91.13 | 90.69 |
| Nitrogen, % | 53.35 | 48.13 | 52.11 | 51.39 |
| MCR, % | 83.53 | 83.32 | 83.19 | 83.47 |
| VR (1000 F+),% | 94.03 | 93.75 | 93.80 | 93.53 |
| **Metal trapping** | | | | |
| V trapping | 1.4% | 23.7% | 2.4% | 1.9% |

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained by the present invention. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items.

This written description uses examples to disclose the invention, including the best mode, and also to enable any person skilled in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

The invention claimed is:

1. A method to prepare a catalyst feed for a system to upgrade a heavy oil feedstock, comprising:

providing a first slurry catalyst that has been used in a hydroprocessing operation with a solid content ranging from 5 to 50 wt. % in soluble hydrocarbons and having less than 80% but more than 10% of original catalytic activity;

removing at least 50% of the soluble hydrocarbon in a deoiling step, generating a deoiled spent catalyst comprising at least 1 wt. % of at least one or more metal contaminants;

treating the deoiled spent catalyst with a treating solution containing at least one of water, a mineral acid, an oxidizing agent, and combinations thereof at a volume ratio of treating solution to deoiled spent catalyst ranging from 2:1 to 100:1 for a treated deoiled spent catalyst having a reduced concentration of the at least one or more metal contaminants;

mixing the treated deoiled spent catalyst with a hydrocarbon diluent, generating a treated deoiled spent catalyst slurry;

providing a fresh slurry catalyst comprising a plurality of dispersed particles in a hydrocarbon diluent as a slurry; and feeding the fresh slurry catalyst and the treated deoiled spent catalyst slurry to the heavy oil upgrade system as a catalyst feed.

2. The method of claim 1, wherein the treating step comprises contacting the deoiled spent catalyst with a treating solution containing water or a mineral acid at a volume ratio of treating solution to deoiled spent catalyst ranging from 2:1 to 100:1, and wherein the at least one or more metal contaminants is vanadium oxide.

3. The method of claim 1, wherein the at least one or more metal contaminants comprises vanadium sulfide and the treating step comprises:

contacting the deoiled spent catalyst with a treating solution containing at least an oxidizing agent at a molar amount in excess of the vanadium sulfide in the deoiled spent catalyst.

4. The method of claim 3, wherein the treating step comprises contacting the deoiled spent catalyst with a treating solution comprising at least one of halogens, oxides, peroxides and mixed oxides, including oxyhalites, their acids and salts thereof.

5. The method of claim 4, wherein the treating step comprises contacting the deoiled spent catalyst with a treating solution comprising hydrogen peroxide or hypochlorite ions.

6. The method of claim 1, wherein the deoiled spent catalyst contains vanadium as the at least one or more metal contaminants, and the treating step comprises contacting the deoiled spent catalyst with a treating solution for a sufficient amount of time to reduce the concentration of the vanadium by at least 20%.

7. The method of claim 1, wherein the deoiled spent catalyst contains vanadium as the at least one or more metal contaminants, and the treating step comprises contacting the deoiled spent catalyst with a treating solution in a multi-cycle wash for a sufficient amount of time to reduce the concentration of vanadium by at least 40%.

8. The method of claim 1, wherein the deoiled spent catalyst contains vanadium as the at least one or more metal contaminants, and the treating step comprises contacting the deoiled spent catalyst with a treating solution for a sufficient amount of time to reduce the concentration of vanadium to less than 500 ppm.

9. The method of claim 1, wherein the deoiled spent catalyst contains vanadium as the at least one or more metal contaminants, and the treating step comprises contacting the deoiled spent catalyst with a treating solution for a sufficient amount of time to reduce the concentration of vanadium as a metal contaminant to less than 200 ppm.

10. The method of claim 1, wherein the deoiled spent catalyst contains vanadium as the at least one or more metal contaminants, and the treating step comprises soaking the deoiled spent catalyst in a treating solution for at least 30 minutes to reduce the concentration of vanadium to less than 500 ppm.

11. The method of claim 1, wherein the deoiling step to remove at least 50% of the soluble hydrocarbons from the first slurry catalyst as a deoiled spent catalyst employs a filtration process selected from cross-flow filtration, dynamic filtration, microfiltration, and combinations thereof.

12. The method of claim 11, wherein the deoiling step employs a cross-flow filtration with a membrane.

13. The method of claim 11, wherein the deoiling step further comprises feeding the first slurry catalyst with at least a solvent to the filtration process at a volume ratio of first slurry catalyst to solvent from 0.10/1 to 100/1.

14. The method of claim 13, wherein the deoiling step generates a deoiled spent catalyst containing less than 2 wt. % soluble hydrocarbons as unconverted heavy oil feed.

15. The method of claim 11, wherein the deoiling step further comprises a thermal treatment step selected from drying, calcination, pyrolyzing, and combinations thereof.

16. The method of claim 1, wherein the deoiling step generates a deoiled spent catalyst containing less than 10 wt. % soluble hydrocarbons as unconverted heavy oil feed.

17. The method of claim 1, wherein the mixing step comprises mixing the treated deoiled spent catalyst in a hydrocarbon diluent selected from vacuum gas oil, naphtha, medium cycle oil, light cycle oil, heavy cycle oil, solvent donor, aromatic solvent, and mixtures thereof, at a weight ratio ranging from 1:5 to 1:10 of treated deoiled spent catalyst to hydrocarbon diluent.

18. The method of claim 1, wherein the providing step comprises providing a first slurry catalyst having between 10 and 75% of the original catalytic activity.

19. The method of claim 1, wherein the providing step comprises providing a providing a first slurry catalyst having more than 25% but less than 50% of the original catalytic activity.

20. The method of claim 1, wherein the feeding of the catalyst feed to the upgrade system comprises feeding the fresh slurry catalyst and the treated deoiled spent catalyst slurry as separate feed streams.

21. The method of claim 1, wherein the feeding of the catalyst feed to the upgrade system comprises feeding the fresh slurry catalyst and the treated deoiled spent catalyst slurry as a single feed stream.

* * * * *